US008920206B1

(12) United States Patent
Bartow et al.

(10) Patent No.: US 8,920,206 B1
(45) **Date of Patent: *Dec. 30, 2014**

(54) INTERLOCKING SWIM NOODLES

(75) Inventors: Davis K. Bartow, Greenville, SC (US); Douglas H. Bartow, Greenville, SC (US)

(73) Assignee: Carolina IP LLC, Greenville, SC (US)

( * ) Notice: Subject to any disclaimer, the term of this patent is extended or adjusted under 35 U.S.C. 154(b) by 109 days.

This patent is subject to a terminal disclaimer.

(21) Appl. No.: 13/368,405

(22) Filed: Feb. 8, 2012

(51) Int. Cl.
*B63C 9/08* (2006.01)

(52) U.S. Cl.
USPC ..... 441/129

(58) Field of Classification Search
USPC ..... 441/129
IPC ..... B63B 35/74
See application file for complete search history.

(56) References Cited

U.S. PATENT DOCUMENTS

| | | | | |
|---|---|---|---|---|
| 3,274,624 | A * | 9/1966 | Noerdinger | 5/710 |
| 3,992,739 | A | 11/1976 | Stevens et al. | |
| 4,472,225 | A | 9/1984 | Bimpson | |
| 4,768,456 | A | 9/1988 | Jones et al. | |
| 5,483,914 | A * | 1/1996 | Wonka et al. | 114/345 |
| 5,685,752 | A | 11/1997 | Fulton, Jr. | |
| 5,779,512 | A | 7/1998 | Rupert | |
| 5,947,050 | A * | 9/1999 | Eva et al. | 114/263 |
| 6,027,393 | A | 2/2000 | O'Rourke | |
| 6,056,613 | A | 5/2000 | Pike | |
| 6,106,349 | A | 8/2000 | Motosko | |
| 6,132,276 | A * | 10/2000 | Leemon | 441/129 |
| 6,182,580 | B1 | 2/2001 | Barrett et al. | |
| 6,494,339 | B1 | 12/2002 | Engelhard et al. | |
| 6,497,919 | B1 | 12/2002 | Hartman | |
| 6,554,677 | B2 | 4/2003 | Leemon | |
| 6,615,762 | B1 | 9/2003 | Scott | |
| 6,790,112 | B2 | 9/2004 | Kirk | |
| 2003/0082986 | A1 * | 5/2003 | Wiens et al. | 446/120 |
| 2008/0226859 | A1 | 9/2008 | Manning et al. | |

* cited by examiner

*Primary Examiner* — Stephen Avila
(74) *Attorney, Agent, or Firm* — Smith Moore Leatherwood LLP; Thomas W. Epting; Matthew S. Bedsole

(57) ABSTRACT

An improved swim noodle system is described. The system has a first interlocking swim noodle with a central core and at least one node, diverging outwardly from the central core, and at least one alcove, converging outwardly from the central core, wherein the node and alcove are arranged to mate by resistance fit with a second interlocking swim noodle.

11 Claims, 3 Drawing Sheets

INTERLOCKING SWIM NOODLES

BACKGROUND

The present invention is related to interlocking swim noodles which greatly increases the utility of extruded closed cell noodles for water play. More specifically, the present invention is specifically related to interlocking swim noodles with interlocking structures which allow the noodles to be arranged in a variety of configurations for increased enjoyment.

Extruded closed cell noodles have been available for water play for many years and they are now a widely recognized toy in swimming areas. They are typically cylindrical, or polygonal, and used merely as an entertainment flotation device. More recently cylindrical couplers, like sleeves, have been provided which allow the noodles to be coupled lengthwise for increased configurations. There has been no suitable method for coupling noodles in perpendicular or parallel side-by-side arrangement which has limited the activities the noodles can be used for.

SUMMARY

It is an object of the invention to provide interlocking swim noodles.

An advantage of the present invention is the large number of configurations available with limited components.

These and other advantages, as will be realized, are provided in an interlocking swim noodle system. The system has a first interlocking swim noodle with a central core and at least one node, diverging outwardly from the central core, and at least one alcove, converging outwardly from the central core, wherein the node and alcove are arranged to mate by resistance fit with a second interlocking swim noodle.

Yet another advantage is provided in an interlocking swim noodle system. The system has a first interlocking swim noodle with a first central core. At least one first node extends from the central core and diverges outwardly. At least one first alcove converges outwardly from the central core. The system also has a second interlocking swim noodle with a second central core. At least one second node extends from the central core and diverges outwardly from said second central core. At least one second alcove converges outwardly from the second central core wherein the second node is arranged to mate by resistance fit with the first alcove.

DESCRIPTION

The present invention is specific to interlocking swim noodles. More specifically, the present invention is related to swim noodles with mating male and female components extending longitudinally generally parallel to the longitudinal axis of the swim noodle wherein the male and female components are interlockable to form closed cell foam structures for water play. Male and female components may be disposed substantially symmetrically about the longitudinal axis, and may be disposed about a periphery of a central core of the swim noodle coaxial with the longitudinal axis. Even more specifically, cross-brace components are provided which interlink perpendicular to interlocking swim noodles thereby allowing for the formation of closed cell foam structures for water play.

The invention will be described with reference to the figures which form an integral part of the invention. Throughout the specification similar elements will be numbered accordingly.

Figure 1:
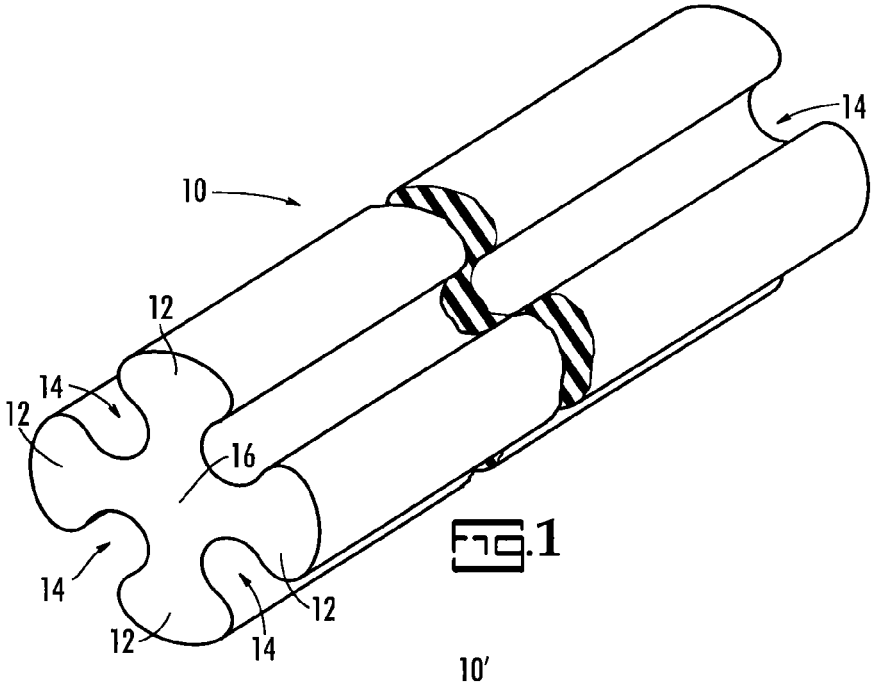
FIG. 1 is a schematic perspective view of an embodiment of the invention.

An embodiment of the invention is illustrated in FIG. 1. In FIG. 1, an interlocking swim noodle, 10, is illustrated in schematic perspective view. The interlocking swim noodle comprises nodes, 12 and alcoves, 14, arranged around a central core, 16. The nodes extend from the core and diverge outwardly from the core and the alcoves converge outwardly from the core such that when a node is inserted into an alcove an interference fit is achieved. In one embodiment the nodes and alcoves are arcuate, preferably with a variable arc, and in a one embodiment the nodes and alcoves are a portion of an obround. It would be apparent that the nodes and alcoves are sufficiently pliable to be distortable to the degree necessary to interlock, and be separated, yet return towards relaxed state to form an interlocking interference fit when joined.

Figure 2:
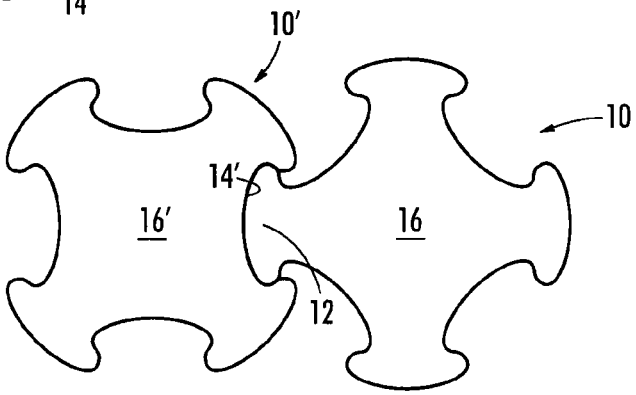
FIG. 2 is a schematic end view of an embodiment of the invention.

An embodiment of the invention is illustrated in schematic end view in FIG. 2 wherein two interlocking swim noodles are engaged with a node, 12, of one interlocking swim noodle, 10, engaged with an alcove, 14', of a second interlocking swim noodle, 10', thereby securing the first core, 16, and second core, 16', in relatively fixed side-by-side and parallel position. In one embodiment the nodes and alcoves are of a generally T-shaped cross-section, as illustrated in FIG. 2. Further, as illustrated in FIG. 2, alternating nodes and alcoves may be disposed substantially symmetrically about the longitudinal axis of the first and/or second interlocking swim noodles, 10 and 10', with nodes diverging radially outwardly from the central core and alcoves converging radially outwardly from the central core. While illustrated with only two interlocking swim noodles engaged any number of interlocking noodles can be engaged to form various configurations including being arranged in common plane, wherein interlocking swim noodles are interlocked on opposite sides of at least one interlocking swim noodle there between, or at angles, wherein interlocking swim noodles are interlocked with at least one interlocking noodle there between at an acute, right or obtuse angle.

Figure 3:
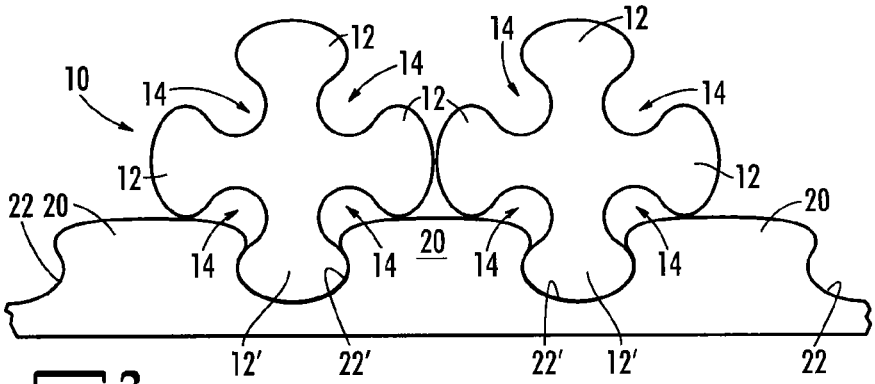
FIG. 3 is a schematic end view of an embodiment of the invention.

An embodiment of the invention is illustrated in schematic side view in FIG. 3. In FIG. 3, an interlocking swim noodle, 10, with nodes, 12, and alcoves, 14, is interlocked with a cross-brace, 18, comprising cross-brace alcoves, 22, and islands, 20. In one embodiment the islands have a width, measured between alcoves, such that adjacent interlocking swim noodles will be in close proximity and preferably in physical contact. As illustrated the node, 12', is inserted into cross-brace alcove, 22'.

Figure 4:
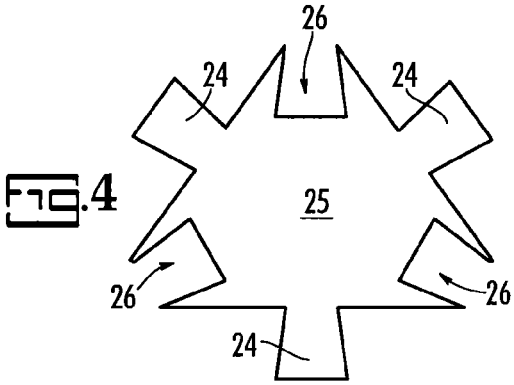
FIG. 4 is a schematic end view of an embodiment of the invention.

An embodiment of the invention is illustrated in schematic end view in FIG. 4. In FIG. 4, the nodes, 24, and alcoves, 26, are trapezoidally shaped thereby allowing for an interference fit when a node of one interlocking swim noodle is inserted into an alcove of the same or an adjacent interlocking swim noodle. The alcoves and nodes are arranged around a central core, 25.

Figure 5:
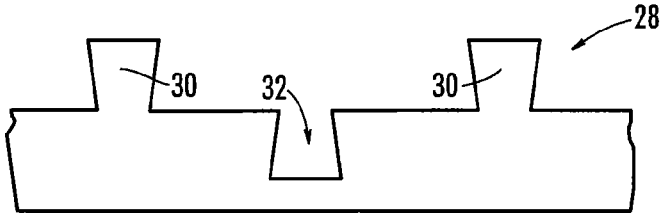
FIG. 5 is a schematic end view of an embodiment of the invention.

An embodiment of the invention is illustrated in schematic end view in FIG. 5. In FIG. 5 a cross-brace, 28, comprising trapezoidally shaped nodes, 30, and alcoves, 32, is provided which allows for the parallel arrangement of interlocking swim noodles in a manner analogous to the embodiment illustrated in FIG. 3.

Figure 6:
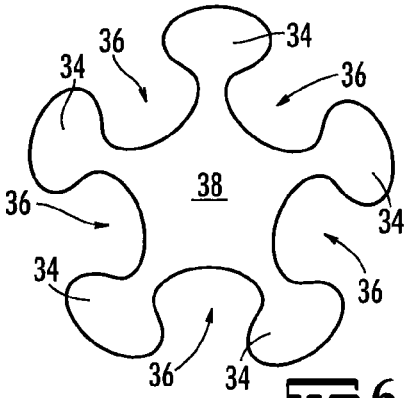
FIG. 6 is a schematic end view of an embodiment of the invention.
Figure 8:
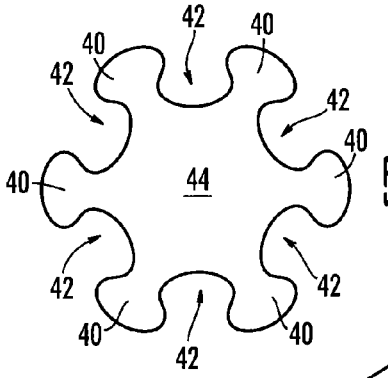
FIG. 8 is a schematic end view of and embodiment of the invention.

Embodiments of the invention are illustrated in end view in FIGS. 6 and 8. FIG. 6 illustrates an interlocking swim noodle with five (5) nodes, 34, and five (5) alcoves, 36, around a central core, 38. FIG. 8 illustrates an interlocking swim noodle with six (6) nodes, 40, and six (6) alcoves, 42, around a central core, 44.

Figure 7:
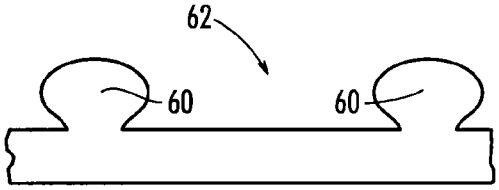
FIG. 7 is a schematic end view of an embodiment of the invention.

An embodiment of the invention is illustrated in schematic side view in FIG. 7. In FIG. 7 a cross-brace, 62, is illustrated with at least one node, 62, thereon for inserting in an alcove of an interlocking swim noodle.

Figure 9:
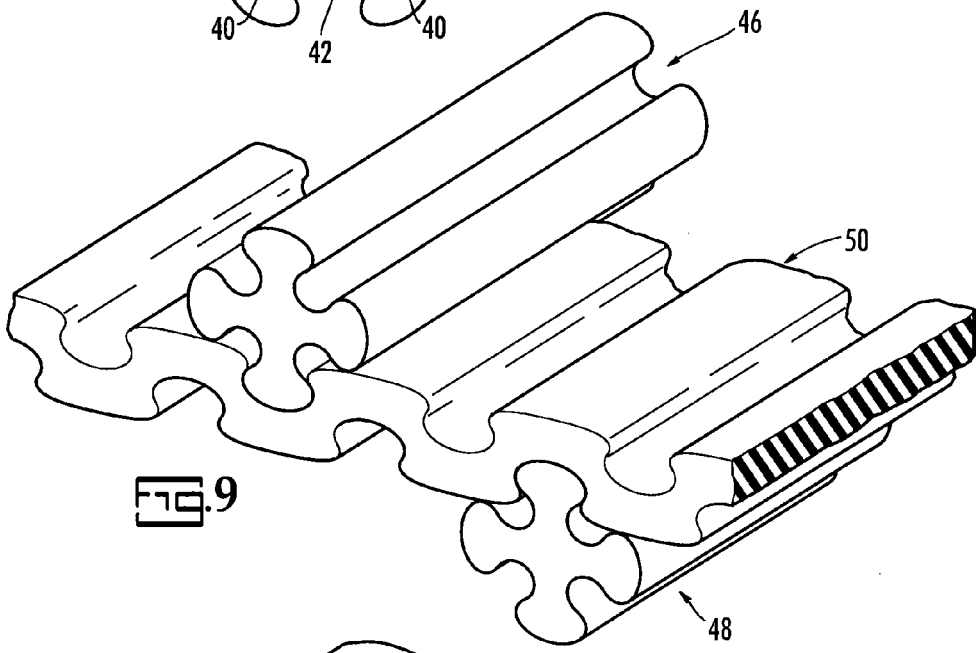
FIG. 9 is a schematic perspective view of an embodiment of the invention.

An embodiment of the invention is illustrated in schematic perspective view in FIG. 9. In FIG. 9, a first interlocking swim noodle, 46, and a second interlocking swim noodle, 48, are interlocked with a cross-brace, 50, wherein nodes of each interlocking swim noodle is inserted into an alcove of the cross-brace. The cross-brace comprises nodes on opposing faces thereby allowing multiple interlocking swim noodles to be arranged on a common face or on opposing faces of the cross-brace. One of skill in the art would immediately realize the large number of available configurations and arrangements provided by the combination of cross-braces and interlocking swim noodles.

Figure 10:
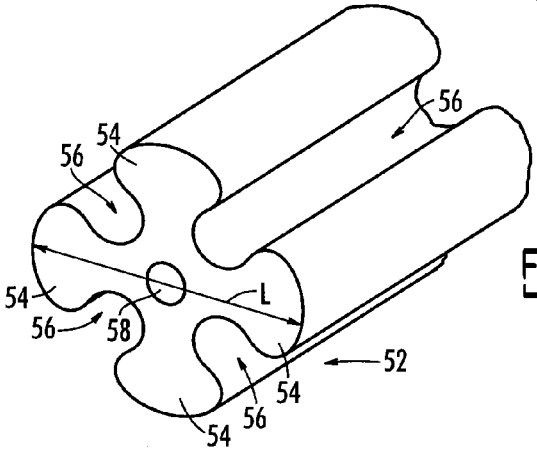
FIG. 10 is a schematic perspective view of an embodiment of the invention.

An embodiment of the invention is illustrated in schematic perspective view in FIG. 10. In FIG. 10, the interlocking swim noodle, 52, comprises mating nodes, 54, and alcoves, 56, around a central core, 58. The core has a void located therein and, preferably, extending the length of the interlocking swim noodle. In one embodiment the void increases yieldability of the nodes and alcoves to facilitate insertion of the node into the alcove. In another embodiment the void minimizes material use for economic efficiency.

The length of the interlocking swim noodle is selected to be of sufficient length to be easily grasped by the hand yet sufficiently short to be easily manipulated. It is preferable that the interlocking swim noodle be at least about 12 inches long to no more than about 6 ft. Below about 12 inches the buoyancy is insufficient to be of interest when used singularly and above about 6 ft in length the interlocking swim noodle is unwieldy in transport and storage. A length of about 3 ft. to about 4 ft. is optimum.

The longest cross-sectional length of the interlocking swim noodle, L in FIG. 10, is sufficiently large to provide nodes with a sufficient strength for interlocking without damage. The longest cross-sectional length is sufficiently small to be easily grasped by the hand of a child or adult of average size. Below a longest cross-sectional length of about 2 inches the nodes have insufficient strength. Above a longest cross-sectional length of about 6 inches the diameter prohibits the interlocking swim noodle from being easily grasped, particularly, by a child.

The interlocking swim noodles and cross-braces are preferably a material with a density which is lower than water. The density is preferably at least about 1.4 to 2.6 pounds per cubic foot and more preferably about 1.8 to about 2.0 pounds per cubic foot since this provides a particularly suitable buoyancy for use as a flotation toy. Synthetic resin materials, such as extruded cellular polyethylene, are exemplary for demonstration of the teachings herein as are other materials which are shape-retaining and yieldable. Close cell structures are highly preferably over open cell structures as is a material which is bio-compatible with swimming environments.

The invention has been described with reference to the preferred embodiments without limit thereto. One of skill in the art would readily appreciate and realize additional embodiments and improvements which are not specifically stated but which are within the scope of the invention as more specifically set forth in the claims appended hereto.

The invention claimed is:

1. An interlocking swim noodle system comprising:

a first elongated swim noodle formed from a material having a density between about 1.4 and about 2.6 pounds per cubic foot, the first elongated swim noodle comprising:

a first central core defining a first longitudinal axis coaxial with said first central core and a first periphery disposed about said first central core;

alternating first nodes and first alcoves disposed about an entirety of said first periphery, said first nodes and said first alcoves being disposed substantially symmetrically about said first longitudinal axis; and a second elongated swim noodle, wherein said first nodes diverge outwardly from said first central core and extend longitudinally generally parallel to said first longitudinal axis, said first nodes being of a generally T-shaped cross-section;

wherein said first alcoves converge outwardly from said first central core and extend longitudinally generally parallel to said first longitudinal axis; and wherein said first nodes and said first alcoves are arranged to mate by resistance fit with said second elongated swim noodle.

2. The interlocking swim noodle system of claim 1 wherein said first central core further comprises an central void.

3. The interlocking swim noodle system of claim 1 further comprising a cross-brace.

4. The interlocking swim noodle system of claim 3 wherein said cross-brace comprises at least one cross-brace node wherein said cross-brace node is arranged to mate by resistance fit with at least one of said first elongated swim noodle and said second elongated swim noodle.

5. The interlocking swim noodle system of claim 3 wherein said cross-brace comprises at least one cross-brace alcove wherein said cross-brace alcove is arranged to mate by resistance fit with at least one of said first elongated swim noodle and said second elongated swim noodle.

6. The interlocking swim noodle system of claim 1 wherein said first elongated swim noodle comprises at least three nodes.

7. The interlocking swim noodle system of claim 1 wherein said first elongated swim noodle comprises at least four nodes.

8. The interlocking swim noodle system of claim 1, wherein said material comprises extruded cellular polyethylene.

9. The interlocking swim noodle system of claim 1, wherein said second elongated swim noodle comprises:

a second central core defining a second longitudinal axis coaxial with said second central core and a second periphery disposed about said second central core; and alternating second nodes and second alcoves disposed about an entirety of said second periphery, said second nodes and said second alcoves being disposed substantially symmetrically about said second longitudinal axis, wherein said second nodes diverge outwardly from said second central core and extend longitudinally generally parallel to said second longitudinal axis, said second nodes being of a generally T-shaped cross-section; and wherein said second alcoves converge outwardly from said second central core and extend longitudinally generally parallel to said second longitudinal axis.

10. An interlocking swim noodle system comprising:

a first elongated swim noodle formed from a material having a density between about 1.4 and about 2.6 pounds per cubic foot, the first elongated swim noodle comprising:

a first central core defining a first longitudinal axis coaxial with said first central core and a first periphery disposed about said first central core;

at least 3 first nodes disposed substantially symmetrically about said first periphery and at least 3 first alcoves disposed alternatingly between said first nodes; and a second elongated swim noodle, wherein said at least 3 first nodes diverge radially outwardly from said first central core and extend longitudinally generally parallel to said first longitudinal axis, said first nodes being of a generally T-shaped cross-section;

wherein said first alcoves converge radially outwardly from said first central core and extend longitudinally generally parallel to said first longitudinal axis; and wherein said first nodes and said first alcoves are arranged to mate by resistance fit with said second elongated swim noodle.

11. A first elongated swim noodle configured to interlock with a second elongated swim noodle, the first elongated swim noodle comprising:

a central core defining a longitudinal axis coaxial with said central core and a periphery disposed about said central core;

alternating nodes and alcoves disposed about an entirety of said periphery, said nodes and said alcoves being disposed substantially symmetrically about said longitudinal axis; and said core and said nodes being formed from a material having a density between about 1.4 and about 2.6 pounds per cubic foot, wherein said nodes diverge outwardly from said central core and extend longitudinally generally parallel to said longitudinal axis, said nodes being of a generally T-shaped cross-section;

wherein said alcoves converge outwardly from said central core and extend longitudinally generally parallel to said longitudinal axis; and wherein said nodes and said alcoves are arranged to mate by resistance fit with said second elongated swim noodle.

* * * * *